US009257025B2

(12) United States Patent
Padula

(10) Patent No.: US 9,257,025 B2
(45) Date of Patent: Feb. 9, 2016

(54) METHOD TO DRIVE AN ANTENNA COIL MAINTAINING LIMITED POWER SOURCE OUTPUT

(71) Applicant: Guillermo H. Padula, Boca Raton, FL (US)

(72) Inventor: Guillermo H. Padula, Boca Raton, FL (US)

(73) Assignee: Tyco Fire and Security GmbH, Rheinfall (CH)

( * ) Notice: Subject to any disclaimer, the term of this patent is extended or adjusted under 35 U.S.C. 154(b) by 133 days.

(21) Appl. No.: 14/211,432

(22) Filed: Mar. 14, 2014

(65) Prior Publication Data

US 2014/0266727 A1 Sep. 18, 2014

Related U.S. Application Data

(60) Provisional application No. 61/798,826, filed on Mar. 15, 2013.

(51) Int. Cl.

| | |
|---|---|
| ***G08B 13/14*** | (2006.01) |
| ***G08B 13/24*** | (2006.01) |
| ***H01Q 1/22*** | (2006.01) |
| ***H01Q 3/30*** | (2006.01) |
| ***H01Q 7/00*** | (2006.01) |
| ***H01Q 21/29*** | (2006.01) |

(52) U.S. Cl.

CPC ..... *G08B 13/2431* (2013.01); *H01Q 1/2216* (2013.01); *H01Q 3/30* (2013.01); *H01Q 7/00* (2013.01); *H01Q 21/29* (2013.01)

(58) Field of Classification Search

CPC ..... G08B 13/2431; G08B 13/24; H01Q 1/22; H01Q 21/29; H01Q 3/30; H01Q 7/00; H01Q 1/2216

USPC ..... 340/572.1–572.8; 343/742–745

See application file for complete search history.

(56) References Cited

U.S. PATENT DOCUMENTS

| | | | | |
|---|---|---|---|---|
| 4,866,455 | A * | 9/1989 | Lichtblau | H01Q 7/04 343/742 |
| 5,608,417 | A * | 3/1997 | de Vall | G06K 7/10336 340/572.5 |
| 5,627,516 | A * | 5/1997 | Balch | G08B 13/2471 340/551 |
| 6,118,378 | A * | 9/2000 | Balch | G01V 3/105 340/572.7 |
| 7,420,463 | B2 * | 9/2008 | Copeland | G06K 7/10336 340/10.1 |
| 7,570,220 | B2 * | 8/2009 | Hall | G08B 13/2477 340/572.7 |
| 8,587,489 | B2 | 11/2013 | Oung et al. | |
| 2008/0303673 | A1 | 12/2008 | Oung | |
| 2010/0311328 | A1 | 12/2010 | Kargl | |

FOREIGN PATENT DOCUMENTS

| | | | |
|---|---|---|---|
| EP | 1693778 | A1 | 8/2008 |

* cited by examiner

*Primary Examiner* — Eric Blount

(74) *Attorney, Agent, or Firm* — Robert J. Sacco; Carol E. Thorstad-Forsyth; Fox Rothschild LLP

(57) ABSTRACT

Electronic article surveillance system includes an antenna system comprised of two or more of resonant circuits. Each resonant circuit includes an exciter coil having at least one wire turn aligned on a common coil axis. A transmitter is coupled to the antenna system and is arranged to generate an antenna system composite exciter signal. The composite exciter signal is comprised of a plurality of co-exciter signals having the same predetermined frequency. The composite exciter signal is capable of exciting an EAS security tag when applied to the antenna system. The transmitter has two or more transmitter output ports, each independently coupled to one of the plurality of resonant circuits. Each of the plurality of co-exciter signals is respectively provided separately from a transmitter output port to one of the of resonant circuits.

14 Claims, 7 Drawing Sheets

METHOD TO DRIVE AN ANTENNA COIL MAINTAINING LIMITED POWER SOURCE OUTPUT

CROSS REFERENCE TO RELATED APPLICATIONS

This application claims the benefit of U.S. Provisional Patent Application Ser. No. 61/798,826 filed Mar. 15, 2013, which is herein incorporated by reference.

BACKGROUND OF THE INVENTION

1. Statement of the Technical Field

The inventive arrangements relate to Electronic Article Surveillance ("EAS") systems, and more particularly to EAS systems that are compliant with certain applicable safety standards.

2. Description of the Related Art

Electronic article surveillance (EAS) systems generally comprise an interrogation antenna for transmitting an electromagnetic signal into an interrogation zone, markers which respond in some known electromagnetic manner to the interrogation signal, an antenna for detecting the response of the marker, a signal analyzer for evaluating the signals produced by the detection antenna, and an alarm which indicates the presence of a marker in the interrogation zone. The alarm can then be the basis for initiating one or more appropriate responses depending upon the nature of the facility. Typically, the interrogation zone is in the vicinity of an exit from a facility such as a retail store, and the markers can be attached to articles such as items of merchandise or inventory.

One type of EAS system utilizes acousto-magnetic (AM) markers. The general operation of an AM EAS system is described in U.S. Pat. Nos. 4,510,489 and 4,510,490, the disclosure of which is herein incorporated by reference. The detection of markers in an acousto-magnetic (AM) EAS system frequently involves use of opposing pedestals placed at an exit. Each pedestal can contain an exciter coil in the form of an inductor type loop antenna comprising one or more loops of wire. A pedestal used in EAS can have a single antenna exciter coil or multiple antenna exciter coils. For example, upper and lower antenna exciter coils are sometimes used. The coils can be fed in series or in parallel by applying an EAS marker tag exciter signal. Multiple coils pedestal antenna systems are described in U.S. Pat. Nos. 8,587,489 and 5,627,516. Other types of EAS systems are known to embed the antenna in the floor in the area of an exit. These types of floor mounted coil systems are sometimes desirable for aesthetic reasons.

Markers are generally detected within a detection zone. When an exciter signal is applied to an EAS antenna in a first pedestal it will generate an electro-magnetic field of sufficient intensity so as to excite markers within the detection zone. In pedestal type systems a second pedestal will generally include an antenna having a main antenna field directed toward the detection zone (and toward the first pedestal). An exciter signal applied at the second pedestal will also generate an electromagnetic field with sufficient intensity so as to excite markers within the detection zone. When a marker tag is excited in the detection zone, it will generate an electromagnetic signal which can usually be detected by receiving the signal at the antennas.

In EAS systems that are used in European countries, it is always desirable (and many times required) that the systems have Limited Power Source (LPS) output circuits designed in accordance with International Electrotechnical Commission standard IEC/EN 60950-1 which concerns safety of information technology equipment. Output circuits designed in accordance with this standard will meet the requirements for NEC Class 2 circuits. This standard, which is established by the IEC, gives a measurement of how safe these outputs are. One of the requirements of the LPS outputs is that the peak output voltage not to exceed 42.4 Volts.

SUMMARY OF THE INVENTION

Embodiments of the invention concern an electronic article surveillance system including an antenna system comprised of a plurality of resonant circuits. Each resonant circuit is comprised of an exciter coil having at least one wire turn aligned on a common coil axis. A transmitter is coupled to the antenna system and is arranged to generate an antenna system composite exciter signal. The composite exciter signal is comprised of a plurality of co-exciter signals having the same predetermined frequency. The composite exciter signal is capable of exciting an EAS security tag when applied to the antenna system. The transmitter has two or more transmitter output ports, each independently coupled to one of the plurality of resonant circuits. Accordingly, each of the plurality of co-exciter signals is exclusively provided to one of the plurality of resonant circuits.

The invention also concerns a method for operating an electronic article surveillance system as described above. The method involves generating with a transmitter a composite exciter signal which is capable of exciting an EAS security tag when applied to an antenna system. The composite exciter signal consists of a plurality of co-exciter signals as described above, each having the same predetermined frequency. The co-exciter signals are respectively provided at output ports of the transmitter. The co-exciter signals are coupled from each of the output ports to the antenna system and applied at the antenna system to a plurality of resonant circuits forming the antenna system. Each resonant circuit of the antenna system includes an exciter coil having at least one wire turn aligned on a common first exciter coil axis.

BRIEF DESCRIPTION OF THE DRAWINGS

Embodiments will be described with reference to the following drawing figures, in which like numerals represent like items throughout the figures, and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The inventive system and method facilitates compliance of an EAS system with certain applicable standards. Specifically, the inventive arrangements facilitate compliance with International Electrotechnical Commission standard IEC/EN 60950-1 which concerns safety of information technology equipment. Output circuits designed in accordance with this standard will meet the requirements for NEC Class 2 circuit, which regulates how safe these outputs are. One of the requirements concerning LPS outputs is that the peak output voltage must not to exceed 42.4 Volts.

In the antenna coils used in EAS, there is little or no design flexibility with regard to the physical size of the antenna coils, mainly because of aesthetics. Consequently the intrinsic parameters of the antenna coils such as inductance, resistance and impedance are largely outside the control of the designer. The antenna coils are part of a resonant circuit and the driving voltages needed for achieving the necessary magnetic field strength tend to be above LPS limits due to the high impedance of the coils. The inventive arrangements provide a solution to reduce the impedance and generate the necessary magnetic field, while maintaining the LPS outputs. The inventive arrangements reduce the necessary output voltage of an EAS transmitter to the acceptable limits but do not compromise the characteristics of the magnetic field needed to achieve the necessary EAS performance.

Figure 1:
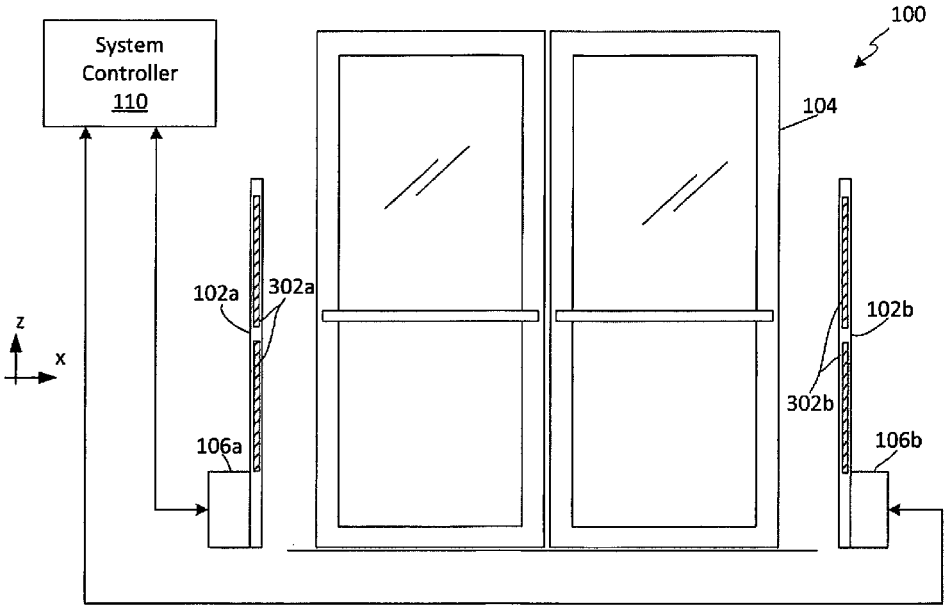
FIG. 1 is a side view of an EAS detection system, which is useful for understanding the invention.
Figure 2:
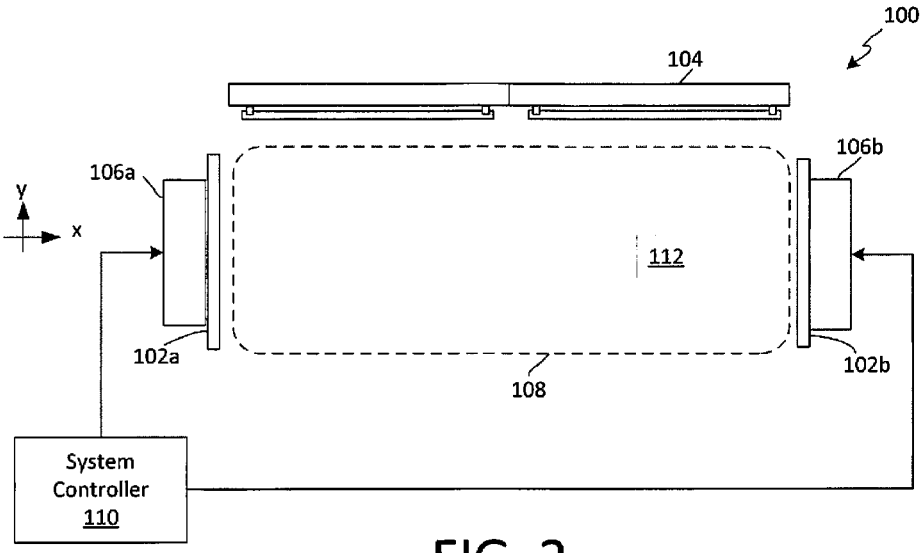
FIG. 2 is a top view of the EAS detection system in FIG. 1, which is useful for understanding an EAS detection zone.

Referring now to the drawings figures in which like reference designators refer to like elements, there is shown in FIGS. 1 and 2 an exemplary EAS detection system 100. The EAS detection system will be positioned at a location adjacent to an entry/exit 104 of a secured facility. The EAS system 100 uses specially designed EAS marker tags ("tags") which are applied to store merchandise or other items which are stored within a secured facility. The tags can be deactivated or removed by authorized personnel at the secure facility. For example, in a retail environment, the tags could be removed by store employees. When an active tag 112 is detected by the EAS detection system 100 in an idealized representation of an EAS detection zone 108 near the entry/exit, the EAS detection system will detect the presence of such tag and will sound an alarm or generate some other suitable EAS response. Accordingly, the EAS detection system 100 is arranged for detecting and preventing the unauthorized removal of articles or products from controlled areas.

A number of different types of EAS detection schemes are well known in the art. For example, known types of EAS detection schemes can include magnetic systems, acousto-magnetic systems, radio-frequency type systems and microwave systems. For purposes of describing the inventive arrangements in FIGS. 1 and 2, it shall be assumed that the EAS detection system 100 is an acousto-magnetic (AM) type system. Still, it should be understood that the invention is not limited in this regard and other types of EAS detection methods can also be used with the present invention.

The EAS detection system 100 includes a pair of pedestals 102*a*, 102*b*, which are located a known distance apart (e.g. at opposing sides of entry/exit 104). The pedestals 102*a*, 102*b* are typically stabilized and supported by a base 106*a*, 106*b*. Pedestals 102*a*, 102*b* will each generally include one or more antennas that are suitable for aiding in the detection of the special EAS tags as described herein. For example, pedestal 102*a* can include at least one antenna 302*a* suitable for transmitting or producing an electromagnetic exciter signal field and receiving response signals generated by marker tags in the detection zone 108. In some embodiments, the same antenna can be used for both receive and transmit functions. Similarly, pedestal 102*b* can include at least one antenna 302*b* suitable for transmitting or producing an electromagnetic exciter signal field and receiving response signals generated by marker tags in the detection zone 108. The antennas provided in pedestals 102*a*, 102*b* include conductive wire coils that will sometimes be referred to herein as inductor type loop antennas, or exciter coils. In some embodiments, a single antenna can be used in each pedestal and the single antenna is selectively coupled to the EAS receiver and the EAS transmitter in a time multiplexed manner. However, it can be advantageous to include two antennas (or exciter coils) in each pedestal as shown in FIG. 1, with an upper antenna positioned above a lower antenna as shown.

The antennas located in the pedestals 102*a*, 102*b* are comprised of resonant circuits which are electrically coupled to a system controller 110. The system controller controls the operation of the EAS detection system to perform EAS functions as described herein. The system controller can be located within a base of one of the pedestals or can be located in other places interior to the pedestal. For example, the system controller could be located in the center of a coil. Alternatively, the system controller could be located within a separate chassis at a location nearby to the pedestals. For example, the system controller 110 can be located in a ceiling just above or adjacent to the pedestals.

EAS detection systems are well known in the art and therefore will not be described here in detail. However, those skilled in the art will appreciate that an antenna or exciter coil of an acousto-magnetic (AM) type EAS detection system is used to generate an electro-magnetic field which serves as a marker tag exciter signal. The marker tag exciter signal causes a mechanical oscillation of a strip (e.g. a strip formed of a magnetostrictive, or ferromagnetic amorphous metal) contained in a marker tag within a detection zone 108. As a result of the stimulus signal, the tag will resonate and mechanically vibrate due to the effects of magnetostriction. This vibration will continue for a brief time after the stimulus signal is terminated. The vibration of the strip causes variations in its magnetic field, which can induce an AC signal in the receiver antenna. This induced signal is used to indicate a presence of the strip within the detection zone. As noted above, the same antenna contained in a pedestal 102*a*, 102*b* can serve as both the transmit antenna and the receive antenna. Accordingly, the antennas in each of pedestals 102*a*, 102*b* can be used in several different modes to detect a marker tag exciter signal.

Figure 3A:
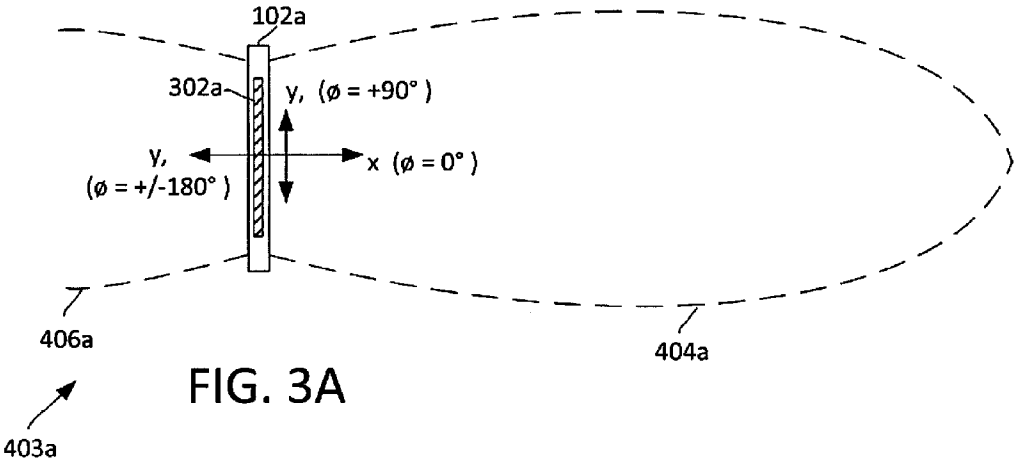
FIGS. 3A and 3B are drawings which are useful for understanding a magnetic field produced by an EAS antenna system.
Figure 3B:
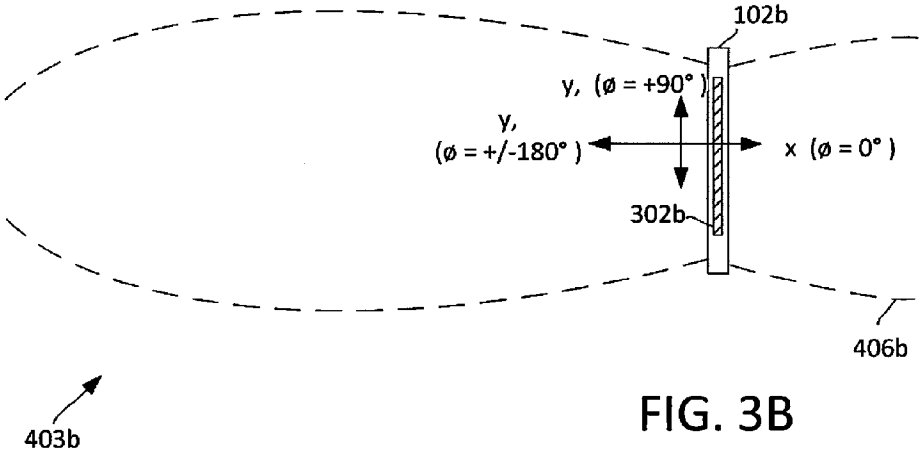

Referring now to FIGS. 3A and 3B, there are shown exemplary antenna field patterns 403*a*, 403*b* for antennas 302*a*, 302*b* contained in pedestal such as pedestal 102*a*, 102*b*. As is known in the art, an antenna radiation pattern is a graphical representation of the radiating (or receiving) properties for a given antenna as a function of space. The exemplary antenna field patterns 403*a*, 403*b* shown in FIGS. 3A, 3B are azimuth plane pattern representing the antenna pattern in the x, y coordinate plane. The azimuth pattern is represented in polar coordinate form and is sufficient for understanding the inventive arrangements. The azimuth antenna field patterns shown in FIGS. 3A and 3B are a useful way of visualizing the area in which the antennas 302*a*, 302*b* will transmit and receive signals at a particular power level sufficient for tag detection.

Figure 4:
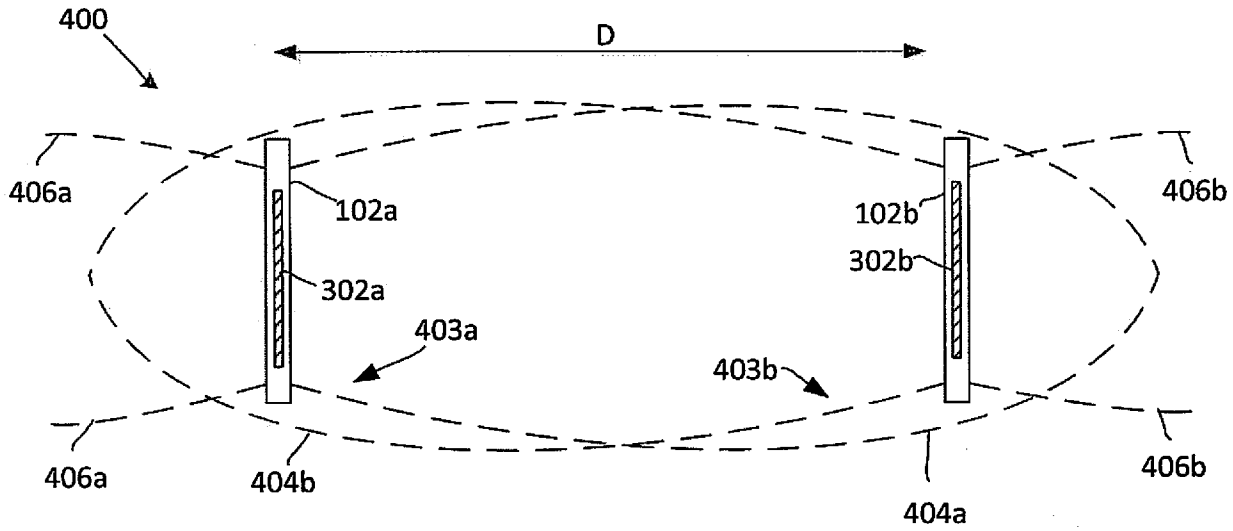
FIG. 4 is a drawing that is useful for understanding a detection zone of an EAS system.

If the driving voltage applied to a given exciter coil or coils is reduced to satisfy LPS requirements, then size of an EAS tag detection zone will be reduced. The antenna field pattern 403*a*, 403*b* shown in FIG. 3A includes a main lobe 404*a* with a peak at ø=0° and a backfield lobe 406*a* with a peak at angle ø=180°. Conversely, the antenna field pattern 403*b* shown in FIG. 3B includes a main lobe 404*b* with its peak at ø=180° and a backfield lobe 406*b* with a peak at angle ø=0°. In an EAS system, each pedestal is positioned so that the main lobe of an antenna contained therein is directed into a detection zone (e.g. detection zone 108). Accordingly, a pair of pedestals 102*a*, 102*b* in an EAS system 400 shown in FIG. 4 will produce overlap in the antenna field patterns 403*a*, 403*b* as shown. Notably, the antenna field patterns 403*a*, 403*b* shown in FIG. 4 are scaled for purposes of understanding the invention. In particular, the patterns show the outer boundary or limits of an area in which an exciter signal of particular amplitude applied to antennas 302*a*, 302*b* will produce a detectable response in an EAS marker tag. A reduction in the peak voltage of a signal applied to the exciter coil (e.g., to satisfy a safety standard) will have the negative effect of reducing the maximum acceptable distance D between pedestals.

The magnetic field intensity within the area defined by the antenna field patterns 404*a*, 406*b* must be sufficient to ensure that an EAS marker tag is excited when placed within the detection zone. Magnetic field intensity is determined by several factors including, the number of turns in each exciter coil, the dimensions of each turn comprising the exciter coil, and the magnitude of the driving voltage applied to the exciter coils. The pedestals 102*a*, 102*b* must be limited in their overall size and dimensions to satisfy aesthetic requirements of retail store operators. Consequently the antenna exciter coils within each pedestal are necessarily limited with respect to their maximum coil dimensions. Due to this fact, there is little or no design flexibility with regard to increasing the physical size of the antenna coils beyond certain acceptable limits. This means that the intrinsic parameters of the antenna coils such as inductance, resistance and impedance are largely outside the control of the designer. Accordingly, the required intensity of magnetic field must generally be achieved by providing a driving voltage of sufficient magnitude. But this creates a problem because the driving voltages needed for achieving the necessary magnetic field strength tend to be above LPS limits due to the relatively high impedance of the coils.

Figure 5:
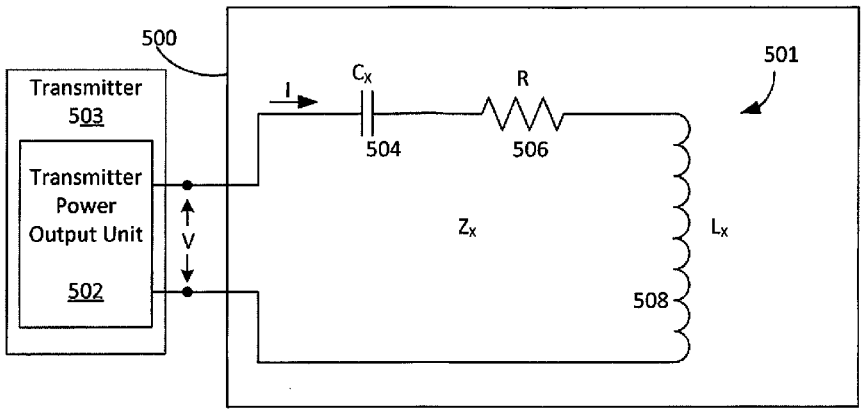
FIG. 5 (Prior Art)
FIG. 5 is a schematic drawing that is useful for understanding a conventional EAS transmitter and antenna arrangement.

Referring now to FIG. 5, there is shown a schematic diagram of an antenna system 500 which is useful for understanding a safety problem associated with a conventional EAS system. An EAS transmitter 503 includes an EAS transmitter power unit 502 which provides an alternating current exciter signal to the antenna system. The exciter signal in an EAS system is typically in the range of between about 50 KHz and 60 kHz, but could range from between 10 kHz and 100 KHz. The antenna system is comprised of a resonant circuit 501 which is used for eliciting a response from an EAS tag within a detection zone. The resonant circuit shown is a series resonant circuit, but the inventive concepts described herein extend to parallel resonant circuits and hybrid resonance circuits as well. The resonant circuit includes an exciter coil 508 which is an inductor having an inductance $L_x$. As noted above, the exciter coil can be disposed within an EAS pedestal or on a floor beneath a retail store exit. The exciter coil 508 has a plurality of turns. The resonant circuit 501 also includes a resistive component 506 having a value R, which represents the resistance of the exciter coil. The resonant circuit also includes a capacitive element 504 which has a capacitance value $C_x$. When the components are arranged in series as shown, the circuit has an overall impedance value represented as $Z_x$. When the resonant circuit is excited by an exciter signal voltage V a current I will flow in the circuit, thereby producing a magnetic field strength H. Accordingly, in the circuit shown in FIG. 5:

R=resistance of the exciter coil
$L_x$=the inductance of the exciter coil
$C_x$=the capacitance value of the series capacitor
N=number of turns in the exciter coil
I=current through the circuit
V=voltage applied to the circuit.
H=magnetic field strength
and, the following relationships are true:
H=N×I
I=V/R
H=N×V/R In an exemplary EAS system of the prior art, the source voltage V necessary for driving a resonant circuit 501 for achieving a satisfactory magnetic field strength is 80 volts, peak. At resonance, the reactive components are cancelled, leaving the resistive or dissipative component R only. If we assume that the number of turns N in exciter coil 508 is 4, and the value of resistor R is 2 ohms, then the a magnetic field strength can be calculated as:

$$H=4\text{ turns}\times 80\text{ V}/2\text{ ohms}=160\text{ Amp turn.}$$

This is a sufficient magnetic field strength to establish an EAS security tag detection zone that is commercially satisfactory. Smaller tag detection zones can be used, but may not be satisfactory from the standpoint of a retail store operator. Still, the problem with this arrangement is that the peak driving voltage V=80 volts exceeds the maximum allowable value for LPS outputs under certain safety standards, such as International Electrotechnical Commission standard IEC/EN 60950-1. One of the requirements concerning LPS outputs is that the output voltage must not to exceed 42.4 Volts peak. But a driving voltage of only 42.4 Volts in the circuit if FIG. 5 will be insufficient to achieve a desired magnetic field strength throughout an desired EAS detection zone.

Figure 6:
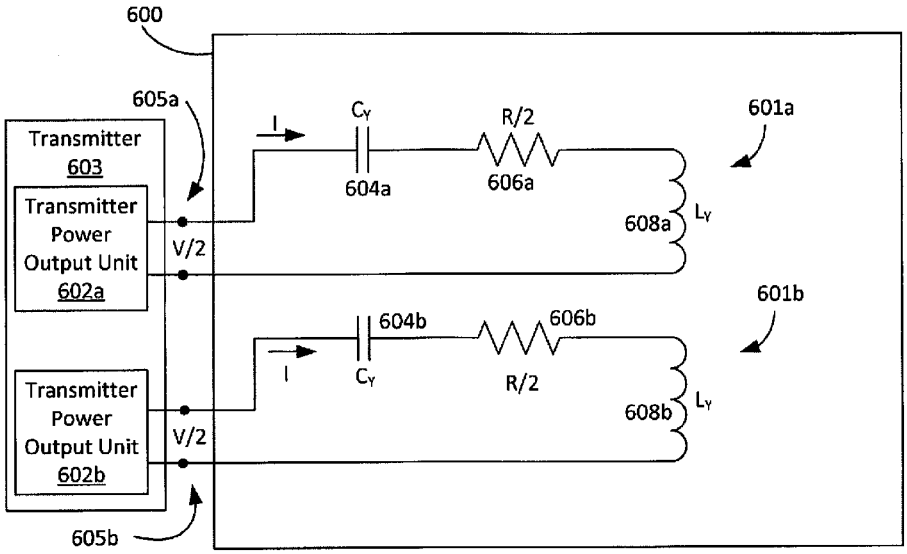
FIG. 6 is a schematic drawing that is useful for understanding an EAS and antenna arrangement in accordance with the inventive arrangements.

Referring now to FIG. 6, the single resonant circuit 501 shown in FIG. 5 is advantageously replaced with two or more resonant circuits 601*a*, 601*b* in antenna system 600. In this example where two resonant circuits are used, the exciter coils 608*a*, 608*b* each has half as many turns as exciter coil 508; however it should be understood that the invention is not limited in this regard and more exciter coils could be used with fewer turns per coil. The resonant circuits shown are series resonant circuits, but the inventive concepts described herein extend to parallel resonant circuits and hybrid resonance circuits as well. With the two exciter coil arrangement shown in FIG. 6, each exciter coil 608*a*, 608*b* has an inductance value $L_y$ which is about half of the inductance value $L_x$. Since the exciter coils 608*a*, 608*b* have half as many turns (e.g., 2 turns), their resistance will be very close or approximately equal to half of the resistance of exciter coil 508. Accordingly, the resistance of such coils can be represented as R/2. A value of Cy can be chosen to ensure that the resonant circuits 601*a*, 601*b* have the same resonant frequency $f_r$ as resonant circuit 501. Notably, because the number of turns in each exciter coil 608*a*, 608*b* is reduced as compared to the exciter coil 508, the inductance of each exciter coil 608*a*, 608*b* will also decrease. Consequently, the values of capacitor 604*a*, 604*b* would need to be increased to maintain the same resonant frequency as in resonant circuit 501.

Each of the resonant circuits 601*a*, 601*b* is excited by a transmitter power output unit 602*a*, 602*b*. The transmitter power units can comprise part of an EAS transmitter 603. For convenience, the plurality of signals output from the plurality of transmitter power output units 602*a*, 602*b* shall sometimes be individually referred to herein as co-exciter signals. This terminology is used since the co-exciter signals together comprise a composite exciter signal output of the EAS transmitter 603 which, when applied to a plurality of resonant circuits 601*a*, 601*b*, is used to excite an EAS tag in a detection zone. The co-exciter signal is preferably in the range of between about 50 KHz and 60 kHz, but could range from between 10 kHz and 100 KHz. A power output port 605*a*, 605*b* of each transmitter power output unit is designed to provide a maximum output voltage of V/2 which in this example would be 40 V peak output. Notably, this is half the voltage supplied to resonant circuit 501, and is well within the 42.4 V maximum allowable value for LPS outputs under a safety standard, such as International Electrotechnical Commission standard IEC/EN 60950-1.

With the arrangement shown in FIG. 6, the magnetic field strength for each exciter coil 608*a*, 608*b* can be calculated as: H=2 turns×40 Volts/1 ohm=80 Amp turns. This is not a sufficiently strong magnetic field to produce an EAS detection zone having a commercially satisfactory distance between conventional EAS pedestals. However, if the co-exciter signals applied to the resonant circuits are properly phased, and the position of the exciter coils are suitably arranged, the resultant magnetic field vectors from the two exciter coils will be spatially aligned and will be in phase. Consequently, the magnitude of the two resulting magnetic fields will add to produce a field strength of H=2×80 Amp turns=160 Amp turns. This field strength is the same as that of the original resonant circuit described in relation to FIG. 5 and is sufficient to provide an EAS detection zone of commercially acceptable size.

Figure 7:
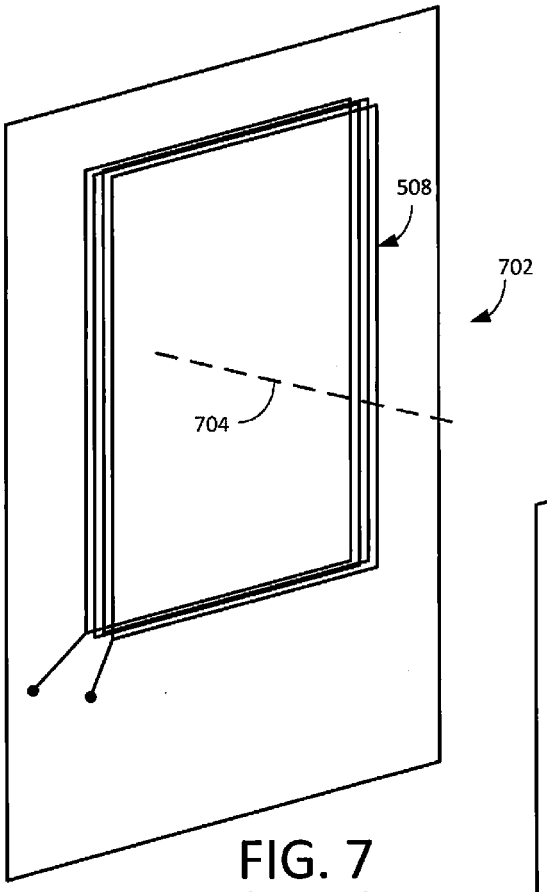
FIG. 7 (Prior Art)
FIG. 7 is a drawing which is useful for understanding an arrangement of a prior art antenna system.

Referring now to FIG. 7, the single exciter coil 508 from resonant circuit 501 is shown in a conventional configuration. The exciter coil 508 can be disposed within an EAS pedestal 702 as shown, but could also be disposed within a wall or within a floor as is known in the art. Each turn of the exciter coil 508 has a substantially rectangular profile as is commonly provided in an EAS pedestal. The turns of the exciter coil are centered about a coil axis 704.

Figure 8:
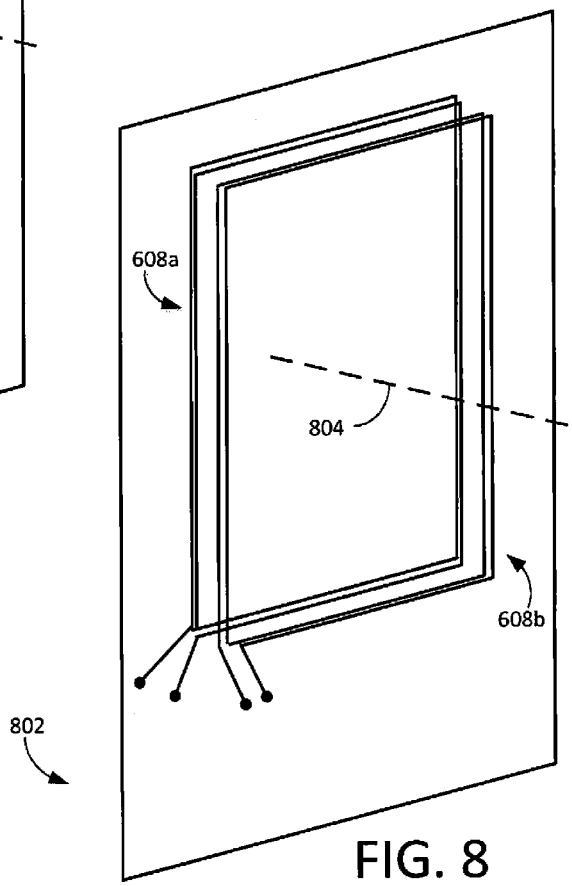
FIG. 8 is a drawing that is useful for understanding an EAS antenna system in accordance with the inventive arrangements.

Referring now to FIG. 8, there is shown an arrangement of the exciter coils 608*a*, 608*b* that is advantageous for producing additive magnetic fields as described above in relation to FIG. 6. In particular, it can be observed in FIG. 8 that exciter coils 608*a* and 608*b* each has substantially the same turns profile (rectangular in this case), with the turns in each exciter coil centered on the same coil axis 804. Further, the two exciter coils are stacked so that they are disposed adjacent to one another. In other words, the coil arrangement in FIG. 8 is similar to that of the single exciter coil of FIG. 7, but the turns of coil 608*a* are electrically separate from those of coils 608*b*. Moreover, the coil 608*a* is independently excited as part of the first resonant circuit 601*a* and the turns of exciter coil 608*b* are excited as part of the second resonant circuit 601*b*. The phase of the co-exciter signal voltage applied to each resonant circuit 601*a*, 601*b* is controlled relative to the phase of the co-exciter signal applied to every other resonant circuit 601*a*, 601*b* to ensure that the resultant magnetic field vectors produced by each coil will be additive. This phase relationship could be different depending upon the exact exciter coil arrangement. But if the two exciter coils 608*a*, 608*b* have the same loop profile size and shape, have the same spatial orientation, and have the same feed point position, then the exciter voltage for each is advantageously in phase (zero degree phase difference).

In conventional EAS pedestal systems, it is known that two or more exciter coils with laterally spatially offset coil axis can be used for certain purposes, such as reducing noise interference. Such an arrangement is shown FIG. 9 where there is shown a partial cutaway view of a pedestal 501. It can be observed in FIG. 9 that there is provided an upper exciter coil 904 and a lower exciter coil 906 with coil axis a1, a2 laterally offset by a distance d. The separate exciter coils in such systems may be excited in series or in parallel, and the phase of the exciter signal applied to each coil can be different. However, the upper coil and the lower coil will each generally comprise only a single coil formed from a plurality of turns. The present invention is to be distinguished from such systems because a plurality of separate exciter coils associated with a plurality of separate resonant circuits are stacked as shown on the same coil axis 804 and are elements of separate and distinct resonant circuits.

Figure 9:
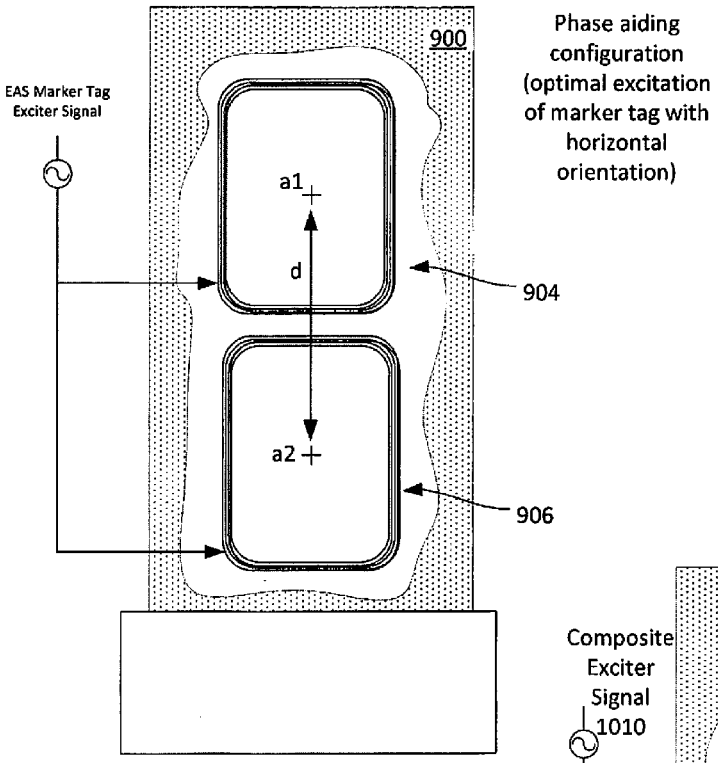
FIG. 9 (Prior Art)
FIG. 9 is a partial cutaway view of an antenna pedestal of the prior art having laterally offset exciter coils.
Figure 10:
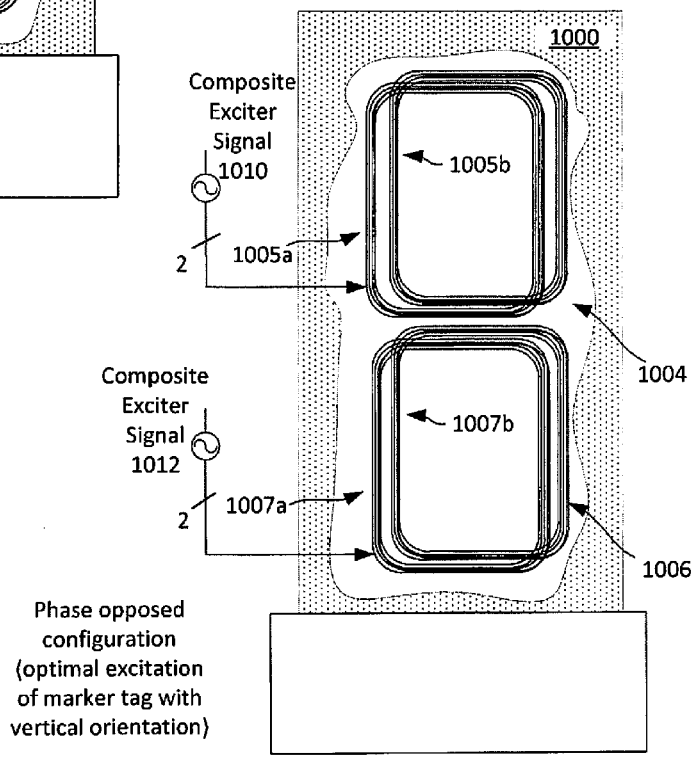
FIG. 10 is a partial cutaway view of an antenna pedestal that is useful for understanding how the inventive arrangements can be used in antenna systems having two or more laterally offset exciter coils.

Notably, the present invention can be extended to systems such as the one shown in FIG. 9 by using multiple coils in place of the single upper coil 904 and in place of the single lower coil 906. Such an arrangement is shown in FIG. 10 and allows these types advanced pedestal systems to also meet the requirements of certain applicable safety standards. As shown in FIG. 10, an upper exciter 1004 can be comprised of two or more exciter coils 1005*a*, 1005*b*. Similarly, a lower exciter 1006 can be comprised of two or more exciter coils 1007*a*, 1007*b*. Each exciter coil 1005*a*, 1005*b* will be part of a separate resonant circuit as discussed in relation to FIG. 6. Similarly, each exciter coil 1007*a*, 1007*b* will be part of a separate resonant circuit. The upper exciter coils 1005*a*, 1005*b* can be excited with a composite exciter signal 1010 (comprised of two separate co-exciter signals in this example). Similarly, the lower exciter coils 1007*a*, 1007*b* can be excited with a composite exciter signal 1012 (also comprised of two separate co-exciter signals). With the foregoing arrangement, each resonant circuit can be excited using a reduced voltage that complies with a safety standard, yet the resultant magnetic field strength in a detection zone can be maintained at a desired level.

In FIG. 10 the exciter coils 1005*a*, 1005*b* are shown slightly offset for clarity and as an aid to understanding the invention. However, it should be understood that these exciter coils will preferably be arranged to have the same coil axis, and the same turn profile. Similarly, exciter coils 1007*a*, 1007*b* are shown to be slightly offset to help illustrate the concept, but it should be understood that such exciter coils will preferably have substantially the same coil axis or center. Also, it should be understood that the inventive arrangements are not limited to systems having upper and lower exciters as shown. Instead, the inventive arrangements can be extended to pedestals having additional arrangements of laterally offset exciter coils.

Figure 11:
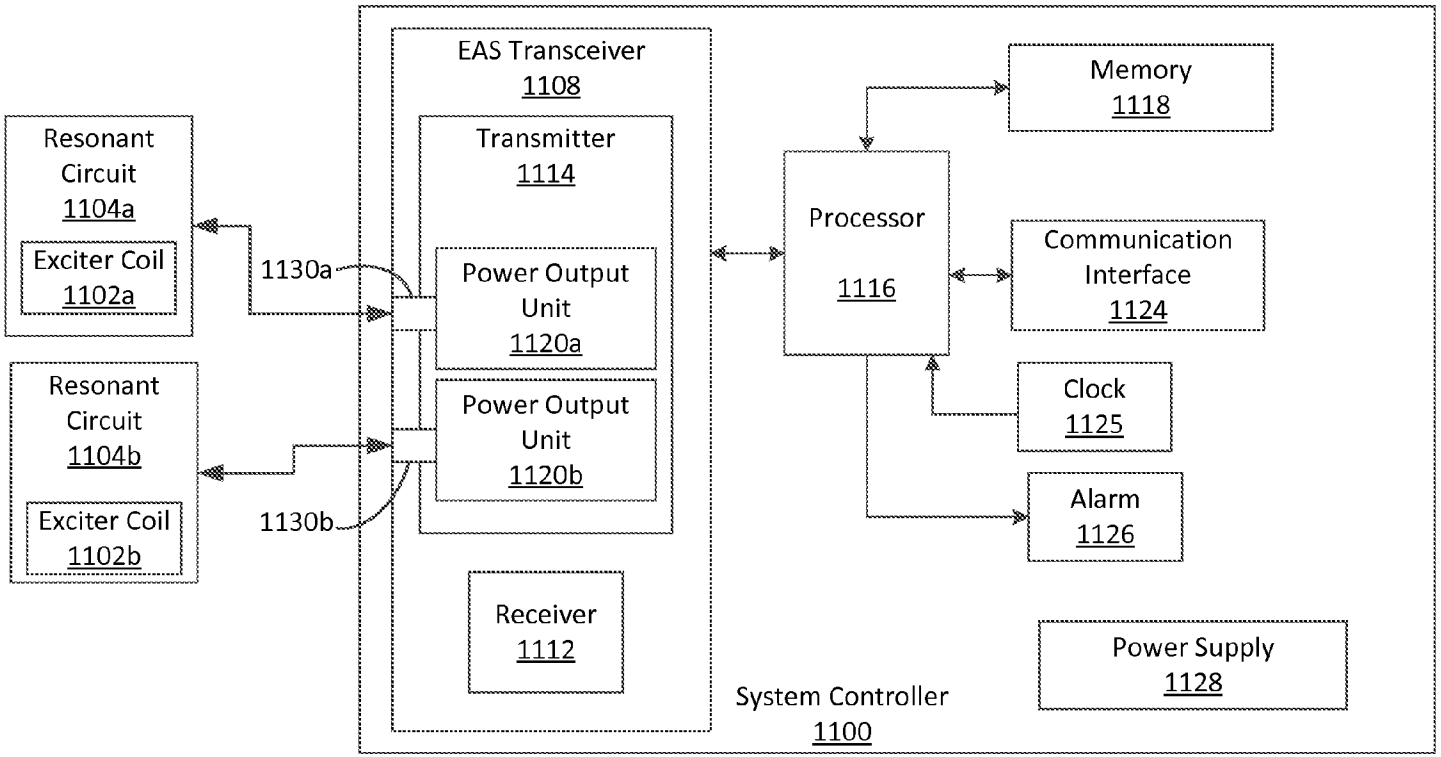
FIG. 11 is a EAS block diagram that is useful for understanding an embodiment of the invention.

Referring now to FIG. 11, there is provided a block diagram that is useful for understanding the arrangement of an EAS system incorporating the inventive arrangements. The EAS system includes a system controller 1100 comprised a processor 1116 (such as a micro-controller or central processing unit (CPU)). The system controller also includes a computer readable storage medium, such as memory 1118 on which is stored one or more sets of instructions (e.g., software code) configured to implement an EAS detection scheme. These instructions can also reside, completely or at least partially, within the processor 1116 during execution thereof.

The system also includes at least one EAS transceiver 1108, including a receiver 1112 and transmitter 1114. The transmitter and receiver circuitry is electrically coupled to resonant circuits 1104*a*, 1104*b* which include exciter coils 1102*a* and 1102*b*. The resonant circuits can be similar to those described above in relation to FIG. 6. Likewise, the exciter coils can be arranged in a manner similar to that described herein with respect to exciter coils 608*a*, 608*b* as shown in FIG. 8.

The transmitter circuitry 1114 includes two or more transmitter power output units 1120*a*, 1120*b* which are similar to transmitter power output units 602*a*, 602*b*. The transmitter power output units will provide co-exciter signals respectively to the resonant circuits 1104*a*, 1104*b*, including exciter coils 1102*a*, 1102*b*. The transmitter circuitry and/or power output units are arranged to ensure that the co-exciter signals produced by each power output unit have a predetermined phase relationship. For example, power output units 1102*a*, 1102*b* can have a zero degree phase difference to ensure that the magnetic fields vectors produced by exciter coils 1102*a*, 1102*b* add together.

The transmitter power output units 1120*a*, 1120*b* are designed to provide at transmitter output ports 1130*a*, 1130*b* the co-exciter signals that are needed for the exciter coils 1102*a*, 1102*b*. The output ports are advantageously designed as Limited Power Source (LPS) output circuits in compliance with a safety standard such as IEC/EN 60950-1. As such, the output ports 1130*a*, 1130*b* will meet the requirements for NEC Class 2 circuits, including the requirement that the peak output voltage not exceed 42.4 Volts, peak. Although separate transmitter power output units 1120*a*, 1120*b* are shown in FIG. 11, it should be understood that alternative implementations are also possible. For example, a single transmitter power output unit can be provided with multiple transmitter output ports, where each port is in compliance with a safety standard such as IEC/EN 60950-1.

A suitable multiplexing arrangement can be provided to facilitate both receive and transmit operations using the exciter coils 1102*a* and 1102*b*. Consequently, transmit operations can occur concurrently at exciter coils 1102*a*, 1102*b* after which receive operations can occur concurrently at such exciter coils to listen for marker tags which have been excited. Additional exciter coils can be provided to implement upper and lower exciters similar to those shown and described with respect to FIG. 10. An upper composite exciter signal can be applied to the upper exciter (which is formed of a plurality of resonant circuits as previously described). A lower composite exciter signal can be applied to the lower exciter (which is also formed of a plurality of resonant circuits as previously described. The upper and lower composite exciter signals can be generated by transmitter circuitry 1110 and controlled by processor 1116 so that the upper and lower exciters operate in a phase aiding or a phase opposed configuration as required.

Additional components of the system controller 1110 can include a communication interface 1124 configured to facilitate wired and/or wireless communications from the system controller 1110 to a remotely located EAS system server. The system controller can also include a real-time clock, which is used for timing purposes, an alarm 1126 (e.g. an audible alarm, a visual alarm, or both) which can be activated when an active marker tag is detected within an EAS detection zone. A power supply 1128 provides necessary electrical power to the various components of the system controller 1110. The electrical connections from the power supply to the various system components are omitted in FIG. 11 so as to avoid obscuring the invention.

Those skilled in the art will appreciate that the system controller architecture illustrated in FIG. 11 represents one possible example of a system architecture that can be used with the present invention. However, the invention is not limited in this regard and any other suitable architecture can be used in each case without limitation.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

We claim:

1. An electronic article surveillance system, comprising:

an antenna system comprised of a plurality of resonant circuits, each resonant circuit including an exciter coil having at least one wire turn aligned on a common coil axis;

a transmitter coupled to the antenna system and arranged to generate an antenna system composite exciter signal comprised of a plurality of co-exciter signals, each having a predetermined frequency which is capable of exciting an EAS security tag when applied to the antenna system;

wherein the transmitter has a plurality of transmitter output ports, each independently coupled to one of the plurality of resonant circuits, whereby each of the plurality of co-exciter signals is exclusively provided from one of the transmitter output ports to one of the plurality of resonant circuits;

wherein each of the co-exciter signals applied to the resonant circuits has the same phase; and wherein the exciter coil in each of the plurality of resonant circuits is oriented to produce a component electromagnetic field which is additive with respect to the component electromagnetic field produced by each said exciter coil in a remainder of the resonant circuits when the resonant circuits are excited by the co-exciter signals.

2. The electronic article surveillance system according to claim 1, wherein the transmitter is arranged to provide each one of the plurality of co-exciter signals with a signal phase in a predetermined phase relationship with a remainder of the plurality of co-exciter signals.

3. The electronic article surveillance system according to claim 2, wherein the transmitter includes at least one phase shifter arranged to shift a phase of at least one of the co-exciter signals to maintain the predetermined phase relationship.

4. The electronic article surveillance system according to claim 1, wherein the transmitter is comprised of a plurality of independent transmitter power output units, each including at least one of said output ports.

5. The electronic article surveillance system according to claim 4, wherein the plurality of independent transmitter power output units are matched to produce co-exciter signals having matched phases.

6. The electronic article surveillance system according to claim 1, where each of said transmitter output ports is configured to have a peak output voltage not exceeding 42.4 Volts.

7. The electronic article surveillance system according to claim 1, where each of the co-exciter signals has a frequency of between about 10 KHz and 100 KHz.

8. The electronic article surveillance system according to claim 1, wherein each said exciter coil provided in each of the resonant circuits is comprised of the same number of turns and have the same turn dimensions.

9. A method for operating an electronic article surveillance system, comprising:

generating with a transmitter a composite exciter signal which is capable of exciting an EAS security tag when applied to an antenna system, the composite exciter signal consisting of a plurality of co-exciter signals, each having the same predetermined frequency and phase;

providing the plurality of co-exciter signals respectively at a plurality of output ports of the transmitter;

coupling the co-exciter signals from each of the output ports to the antenna system;

at the antenna system, applying the plurality of co-exciter signals respectively to a plurality of resonant circuits forming the antenna system, each resonant circuit including an exciter coil having at least one wire turn aligned on a common first exciter coil axis;

wherein the exciter coil in each of the plurality of resonant circuits is oriented to produce a component electromagnetic field which is additive with respect to the component electromagnetic field produced by each said exciter coil in a remainder of the resonant circuits when the resonant circuits are excited by the co-exciter signals.

10. The method according to claim 9, further comprising controlling each of the plurality of co-exciter signals applied to the plurality of resonant circuits so that there is a predetermined phase relationship among the co-exciter signals.

11. The method according to claim 10, further comprising controlling each of the plurality of co-exciter signals to have approximately the same peak voltage.

12. The method according to claim 9, further comprising limiting a peak output voltage from each output port so as not to exceed 42.4 Volts.

13. The method according to claim 9, further comprising selecting a frequency of each of the co-exciter signals of between about 10 KHz and 100 KHz.

14. The method according to claim 9, further comprising generating with the transmitter a second composite exciter signal which is capable of exciting an EAS security tag when applied to an antenna system, the second composite exciter signal consisting of a second plurality of co-exciter signals, each having the same predetermined frequency;

providing the second plurality of co-exciter signals respectively at a second plurality of output ports of the transmitter;

coupling the second plurality of co-exciter signals from each of the second plurality of output ports to the antenna system;

at the antenna system, applying the second plurality of co-exciter signals respectively to a second plurality of resonant circuits forming the antenna system, each of the second plurality of resonant circuit including an exciter coil having at least one wire turn aligned on a common second exciter coil axis, the second exciter coil axis laterally offset from the first exciter coil axis.

* * * * *